US005675606A

United States Patent [19]

Brainard et al.

[11] Patent Number: 5,675,606

[45] Date of Patent: Oct. 7, 1997

[54] SOLENOID AND MONOCUSP ION SOURCE

[75] Inventors: John Paul Brainard; Erskine John Thomas Burns; Charles Hadley Draper, all of Albuquerque, N. Mex.

[73] Assignee: The United States of America as represented by the United States Department of Energy, Washington, D.C.

[21] Appl. No.: 407,455

[22] Filed: Mar. 20, 1995

[51] Int. Cl.[6] ..... H01J 7/24

[52] U.S. Cl. ..... 315/111.71; 315/111.81

[58] Field of Search ..... 315/111.21, 111.51, 315/111.41, 111.81; 312/231.41, 231.51; 250/423 R, 426, 423 F

[56] References Cited

U.S. PATENT DOCUMENTS

| | | | |
|---|---|---|---|
| 3,798,488 | 3/1974 | Pleshivtsev et al. | 313/231 |
| 4,529,571 | 7/1985 | Bacon et al. | 376/144 |
| 5,468,363 | 11/1995 | Falabella | 315/111.41 |

OTHER PUBLICATIONS

J. P. Brainard et al., "Single-Ring Magnetic Cusp Ion Source," *Rev. Sci. Instrum.*, vol. 54, No. 11, Nov. 1983, pp.1497–1505.

*Primary Examiner*—Robert Pascal
*Assistant Examiner*—Michael Shingleton
*Attorney, Agent, or Firm*—Luis M. Ortiz; James H. Chafin; William R. Moser

[57] ABSTRACT

An ion source which generates hydrogen ions having high atomic purity incorporates a solenoidal permanent magnets to increase the electron path length. In a sealed envelope, electrons emitted from a cathode traverse the magnetic field lines of a solenoid and a monocusp magnet between the cathode and a reflector at the monocusp. As electrons collide with gas, the molecular gas forms a plasma. An anode grazes the outer boundary of the plasma. Molecular ions and high energy electrons remain substantially on the cathode side of the cusp, but as the ions and electrons are scattered to the aperture side of the cusp, additional collisions create atomic ions. The increased electron path length allows for smaller diameters and lower operating pressures.

25 Claims, 6 Drawing Sheets

SOLENOID AND MONOCUSP ION SOURCE

The Government has rights in this invention pursuant to Contract No. DE-AC04-94AL85000 between the U.S. Department of Energy and Martin Marietta Corporation.

This invention is an ion source, and more particularly, is a solenoid and monocusp ion source having low pressures and a long mean free path to generate atomic ions which can be used, for example, in accelerators, neutron generators, mass spectrometers, and for ion implantation.

Neutron activation analysis uses pulsed neutron bursts from a neutron generator and is useful to detect hazardous wastes, explosives, and fissile materials. Neutron activation excites or makes nuclear reactions with constituent elements in an unknown material and the gamma ray spectrum from the deexcitation or nuclear reaction identify the elements in the unknown material. In addition to gamma rays, fission neutrons from fissile material can be used to measure the amount of fissile material.

The smallest neutron generators used in nuclear activation have a vacuum tube in which a gaseous mixture of tritium and deuterium isotopes is ionized by energetic collisions with electrons. The ions then are accelerated in a beam into a hydrided target at energies on the order of a hundred kiloelectron volts. For example, a small neutron source called the Zetatron, used since the mid 1970s for uranium borehole logging, portal security monitoring and transuranic assaying, generates neutrons by accelerating a mixed deuterium and tritium ion beam into a hydrided target of deuterium and tritium. These small neutron generators, however, are of limited use because the ion source produces molecular or diatomic ions which produce a lower neutron yield than atomic ions. Because the neutron output is low, longer times are necessary to acquire enough data for activation analysis. The Zetatron has insufficient neutron output to enable the analysis of many materials; either it takes hours to produce enough data or there is not enough activation for detection. In addition, high pressure within the vacuum tube scatters the ion beam and creates secondary electrons. To compensate for the creation of secondary electrons, the power must be increased. Secondary electrons also contribute to high-voltage breakdown. Zetatron generators, moreover, have not been optimized for reliability using beam transport codes.

Yet another ion source is the Single-Ring Magnetic Cusp Low Gas Pressure Ion Source, U.S. Pat. No. 4,529,571 to Bacon et al, which is hereby incorporated by reference. Unlike U.S. Pat. No. 4,529,571, the present invention uses solenoidal magnetic rings in addition to a single monocusp magnet to develop the magnetic fields and to increase the path length of the electrons which allows for decreased pressure. In a sealed accelerator tube, the pressure must be held as low as possible in the accelerator region to minimize secondary electrons and increase high voltage hold-off. The ion source of U.S. Pat. No. 4,529,571 cannot be scaled down to that of the invention described herein because unacceptably high pressures would be required for its operation, i.e. the path length of the electrons is too short. The improvement herein couples a solenoidal magnetic field with a cusp magnetic field to increase the path length of electrons and decrease the diameter at least six fold, which allows for ion production in a smaller volume at a given pressure than U.S. Pat. No. 4,529,571. Moreover, the ion source of U.S. Pat. No. 4,529,571 is not pulsed.

It is thus a primary object of the invention to create a smaller ion source which generates a high percentage of atomic ions in an ion beam. The features which achieve this object is the production of molecular ions from high energy electrons on the cathode side of a monocusp magnetic field and the dissociation of the molecular ions with lower energy electrons on the extraction side of the monocusp magnetic field near the aperture of the device.

It is yet another object of the invention to control the power density of the ion beam at the aperture. By varying the distance between the aperture and the adjacent solenoidal magnet, the magnetic field at the aperture can be controlled, and thereby the electron and ion density can be controlled.

It is a further object of the invention to make a more portable, more efficient ion source. This object is realized by coupling a solenoidal magnetic field with a monocusp magnetic field which reduces the diameter of the ion source.

Another object of the invention is to minimize the operating pressure of the ion source to improve atomic ion production. In order to decrease the pressure, the invention has incorporated a design which allows for a long path length for the electrons which increases the probability of collisions with neutral gas molecules within the plasma.

It is yet another object of the invention to prevent beam scattering and secondary electrons from the accelerator region which can damage the ion source. This object is achieved because the ion source is operated at low pressure. Secondary electrons can be absorbed by an axial beam catcher near the cathode.

It is another object of the invention to provide an electron filter which separates high energy from low energy electrons. This object is achieved by trapping higher energy electrons in a magnetic cusp created by the monocusp magnet so that they are reflected back towards the cathode. Lower energy electrons diffuse towards the front plate by scattering events.

And another object of the invention is to create an ion source which can optimize the current density on a target using beam transport codes by the presence of a screen that separates the ion source from the high voltage region of a sealed neutron tube.

It is a further object of the invention to create a cathode design which provides an efficient high electron current output. The feature of the invention which achieves this is the use of a material having a low work function, such as lanthanum hexaboride.

It is a further object of the invention to provide for a more uniform and symmetric electron flow emitted from the cathode. This object is achieved by the improved cathode design of a hollow truncated cone and by indirectly heating the cathode. This in turn enables the added advantage of maintaining the cathode potential constant over the area of the cathode.

It is another object of the invention to provide a cathode having low power requirements. This object is achieved by effective heat shielding of the cathode.

It is yet another object of the invention to provide a cathode with a long life time by lowering the electron current density at the cathode surface.

These and other objects of the invention are achieved by an ion source comprising a nonmagnetic housing enclosing a vacuum envelope between a rear wall and a front wall, with the front wall having an aperture for passage of ions from the housing; a cathode positioned within the housing near but electrically insulated from the rear wall; an anode supported between the cathode and the aperture within the housing, the anode for energizing electrons emitted from the cathode when a voltage is applied between the anode and cathode, the anode being electrically insulated from both the cathode and housing; a reflector within the housing located between the anode and aperture, with the reflector being electrically insulated from the cathode, the anode, and the housing; a monocusp magnet, positioned exterior to the vacuum envelope behind and adjacent to the reflector, the monocusp magnet for forming a monocusp magnetic field on the reflector; at least one solenoid magnet positioned exterior to said vacuum envelope on a side of the monocusp magnet towards the cathode, the solenoid magnet for forming an axial solenoidal magnetic field to extend the path length of electrons; and a gas source to fill the vacuum envelope with a gas; whereby electrons emitted from the cathode and accelerated toward the anode along the solenoidal magnetic field lines and are reflected at the monocusp magnetic field at the reflector and travel between the cathode and the reflector along the solenoidal and monocusp magnetic field lines, which electrons ionize the gas to form a plasma within said vacuum envelope into molecular ions and the molecular ions pass through the monocusp magnetic field toward the aperture and dissociate into atomic ions by low energy electrons that have been scattered towards the aperture.

It is envisioned that the preferred geometric shape of the ion source is a cylinder with a small diameter and the solenoid and monocusp magnets are permanent ring bar magnets. The magnets can be tuned for particular applications by sizing or positioning the bar magnets or partially shunting the permanent bar magnets with iron. Moreover, the solenoidal magnetic field need not be symmetric about the monocusp field, but in order to increase the path length of the electrons, it is preferable to create some distance between the cathode and the reflector, which is the distance the electrons travel along the solenoidal and monocusp magnetic field lines so that lower pressure operation is possible. The invention also incorporates a novel cathode design using a hollow truncated cone of lanthanum hexaboride which is indirectly heated and heat shielded. Both the design and choice of materials yield a more efficient source of electrons. The indirectly heated cathode has no potential drop across the emitting surface so that electrons are emitted at the same potential.

This invention is further described with particularity in relation to the drawings herein.

DETAILED DESCRIPTION OF THE INVENTION

Reference is made in detail to the present preferred embodiment of the invention, an example of which is illustrated in the accompanying drawings.

Figure 1:
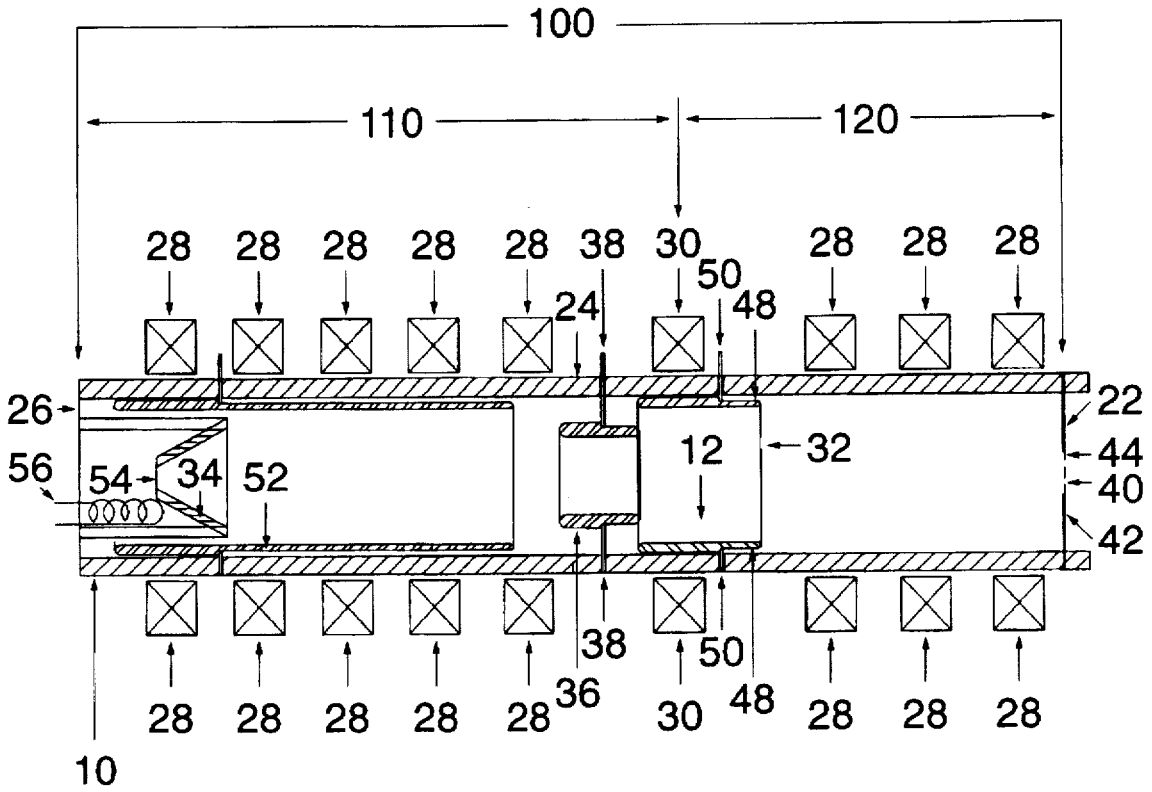
FIG. 1 is a schematic of the ion source of the invention.

The invention herein is an apparatus and method for generating atomic deuterium and tritium ions; and in FIG. 1, the solenoid and monocusp ion source is generally referred to as 10. The ion source 10 could be optimized to produce ions other than deuterium and tritium ions, such as boron, phosphorous, arsenic, or other ions for ion implantation in semiconductor applications, by varying the arc voltage, gas pressure and magnet position relative to the anode. The ion source 10 comprises a non-magnetic vacuum envelope 100 having a front plate 22, a sidewall 24 and rear plate 26, formed of stainless steel or ceramic, and attached with vacuum flanges (not shown). Although the ion source 10 is illustrated in the preferred embodiment as having a cylindrical cross-section, the invention could be configured in other geometries, e.g. square, triangular, or oval. In the cylindrical configuration, the ion source 10 preferably has the approximate dimensions of fifteen centimeters from the front plate 22 to the rear plate 26, and the outside diameter of the sidewall 24 is approximately two and one-half centimeters. The distance between the front plate 22 and rear plates 26 could be extended for operation at lower pressures, which in turn could result in an even smaller diameter.

The basic components of the ion source 10 contained within the vacuum envelope 100 are a cathode 34, an anode 36, a reflector 32. The basic components exterior to the vacuum envelope 100 comprise magnets 28 and 30 which, with a cylindrical configuration, are solenoidal magnetic rings 28 and a monocusp magnetic ring 30 whose magnetic fields penetrate into the vacuum envelope 100. The ion source 10 is powered by a power supply capable of delivering five hundred volts and fifteen amperes between cathode 34 and anode 36. The gas to be ionized may be supplied by either an external gas bottle or internal reservoir 56; the power supply (not shown) for an internal reservoir 56 can be as low as ten watts. Heat shield 52 surrounds at least cathode 34 and floats at or near cathode potential, or can be tied to cathode potential.

The operating principle of the ion source 10 is that the vacuum envelope 100 is associated with either an external bottle of the gas to be ionized or an internal metal hydride reservoir 56. While the parameters for current, voltages and pressures presented herein apply to hydrogen isotopes, it is to be understood that other gases may be ionized within the ion source with different values. When the internal reservoir 56 is heated, gas is released into the vacuum envelope 100 which reaches an equilibrium pressure on the order of three to five millitorr for deuterium and tritium, depending on temperature. Then, when the gas pressure is sufficiently high and when the cathode 34 is heated and the anode 36 is energized by a power source, an electric discharge is created between the anode 36 and cathode 34. In the cylindrical configuration with the use of a heated hollow truncated cathode and deuterium and tritium gas, power of approximately five hundred volts at a few amperes will create the arc. When the cathode and anode are energized, the plasma is essentially at anode potential and electrons are drawn from the cathode 34 and accelerated towards the anode 36 and are reflected back to the cathode 34 by the magnetic field's cusp generated by the monocusp magnet 30. The magnetic fields of the solenoid and the monocusp magnets 28 and 30 have little effect on ion motion because of the large mass of the ions.

Figure 2:
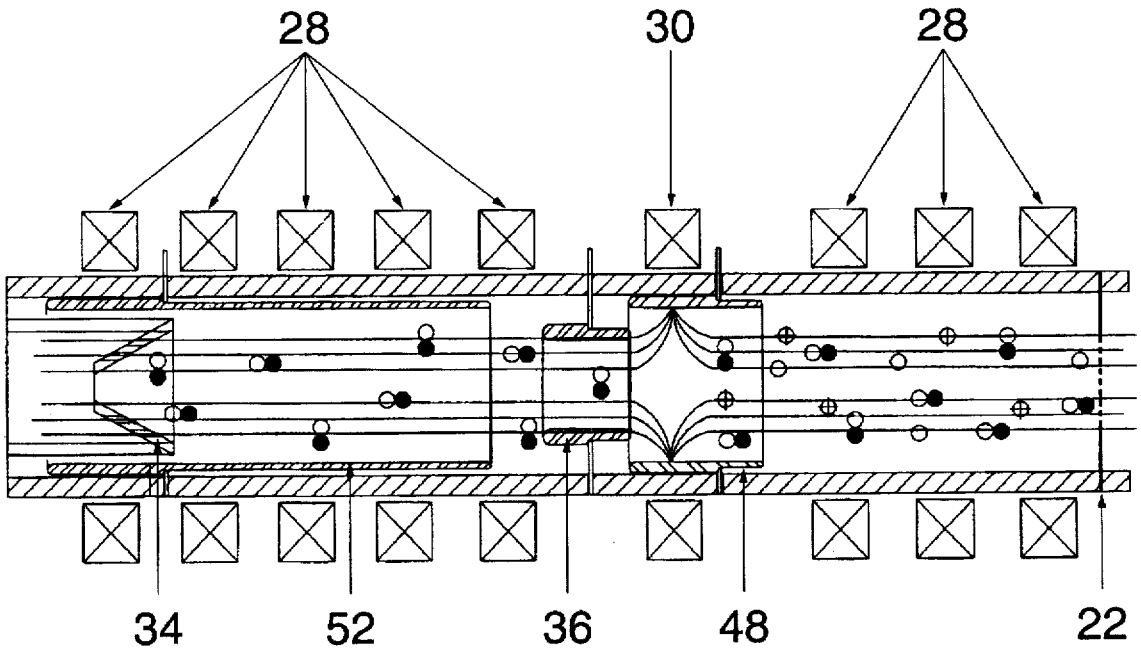
FIG. 2 is a diagram of the magnetic flux lines and the electron and ion paths within the FIG. 3 is a schematic of the improved cathode used in the preferred embodiment of the invention.

The ion source 10 takes advantage of the fact that collisions between the neutral gas within the plasma and high energy electrons result in molecular, mainly diatomic, ions, and that collisions between low energy electrons and the molecular ions dissociate the molecular ions into atomic ions. The higher energy cathode electrons are confined between the cathode 34 and the monocusp field at the reflector 32 when the plasma just grazes the anode 36 as shown in FIG. 2. Molecular ions are formed on the cathode side 110 of the vacuum envelope 100 by electrons with energies near seventy five electron volts. Other electrons, however, move to the aperture side 120 of the vacuum envelope 100 through scattering events which lower the energy of the electrons. Molecular ions are then dissociated into atomic ions as they drift to the aperture side 120 of the vacuum envelope 100 where they are bombarded by these lower energy electrons of approximately fifteen electron volts. The ion source 10, therefore, serves an efficient energy filter for electrons. A few electrons can flow directly through the center axis 12 of the tube or cylinder but these high energy electrons can be stopped by a plug on the low energy side, the aperture side 120, of the cusp. A better solution is to use a hollow cathode, so that no electrons are emitted down the center of the cylinder.

Figure 3:
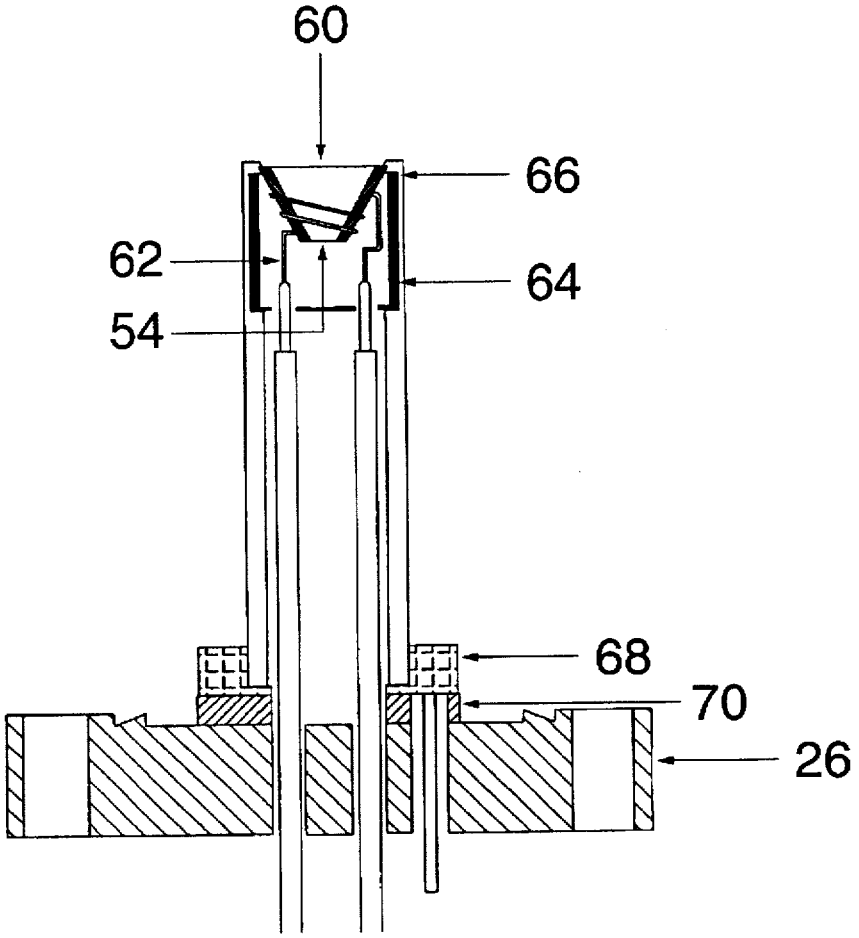

Various cold and heated cathodes can and have been used with the ion source 10, including dispenser cathodes and tungsten filaments. FIGS. 1 and 3 depict an improved cathode 34. The cathode 34 comprises a hollow truncated cone 60, which geometry actually minimizes the electrons in the center of the source or on axis 12. This geometry minimizes the current density at the cathode surface and reduces erosion. The preferred choice of cathode material has a low work function, a low erosion rate, is relatively inert to the plasma, and can operate at low temperatures. Operation at low temperatures increases the lifetime of the cathode without incorporating external cooling. Lanthanum hexaboride, $LaB_6$, for instance, has these qualities.

Figure 4:
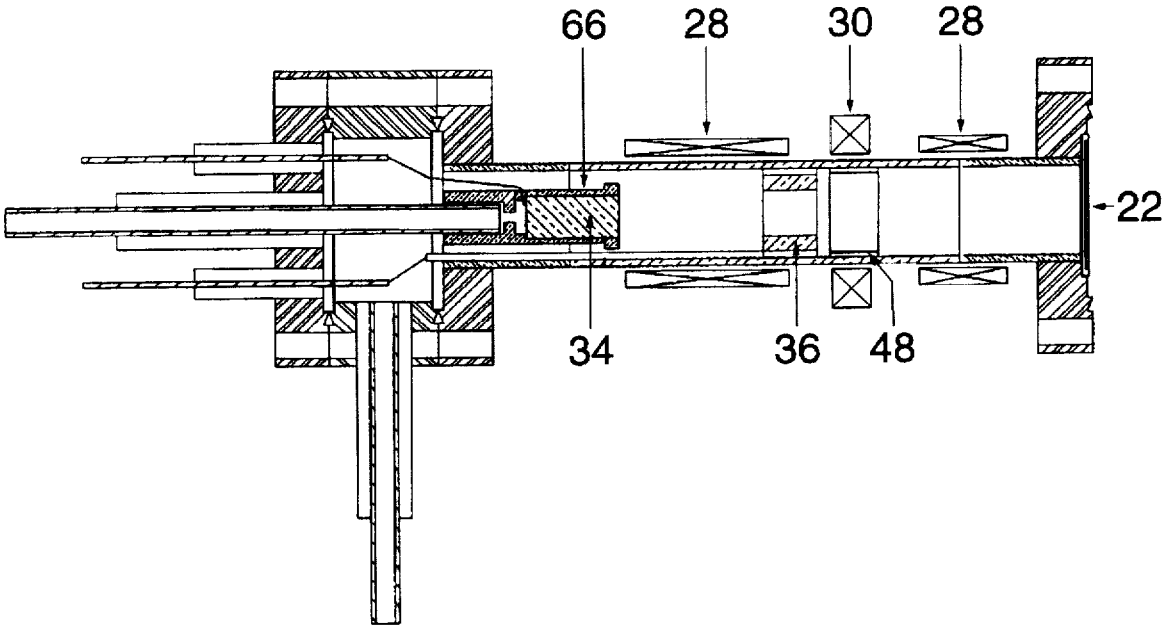
FIG. 4 is a schematic of a demountable embodiment of the ion source of the invention.

If the cathode 34 requires heating, means for either directly or indirectly heating the cathode 34 is provided. The hollow truncated cone cathode 34 incorporates a heating filament 62 wrapped in a spiral arrangement around the cathode 34 for indirect heating. The heating filament 62 is supplied with heating current from a power source. The power supply for the cathode heater depends on the emissive material and the efficiency at which power is delivered but heater power is typically between fifty and one hundred watts. An efficient cathode operates at a minimum of fifty watts, e.g., two volts and twenty-five amperes. By indirectly heating the cathode 34 in this manner the cathode 34 is at one potential so the electron flow is more uniform and axially symmetric; however, a cathode of lanthanum hexaboride has been used which has also been directly heated. The cathode 34 may also be demountable for easy replacement. Alternately, the cathode 34 may be more permanent affixed to the ion source 10. FIG. 4 is a demountable embodiment of the ion source 10 which allows access to the cathode 34.

Electrons emitted by the heated cathode 34 follow the magnetic fields created by the solenoidal and monocusp magnets 28 and 30 as they travel toward the anode 36. Heat shield 64 surround the cathode material 60 and the heating filament 62. A cathode support 66, typically of graphite, then is exterior to and abuts the heat shield 64. Heat shields 52 and 64 prevent large heat losses, thus requiring less power to heat the cathode material 60 to emit electrons. The cathode support 66 is embedded in a conductive spacer 68 which is next to an insulator 70 with the insulator being attached to the rear plate 26. The output arc current from the cathode can be as high as twenty amperes. The cathode design described herein is much more durable than the typical dispenser cathodes which, although they are operable with as little as fifty watts of power and can generate arc currents over ten amperes, they have very short lives in deuterium discharges and fail after a few hours of operation.

Returning to FIG. 1 and spaced radially inwardly from the vacuum envelope and axially between the cathode 34 and the exit aperture 22 is the anode 36 which, when energized, energizes the primary electrons. The position of the anode 36 with respect to the monocusp magnetic ring 30 and the cathode 34 is critical. The anode 36 must be positioned so the outer boundary of the plasma grazes the anode 36. If the anode 36 interferes too much with the plasma too many electrons are lost for efficient operation of the ion source 10 or, if the anode 36 is too far from the plasma boundary, the arc extinguishes. The anode 36 is held firmly in place by feedthrough supports 38. The anode 36 is preferably a ring, either narrow or more extended, made of a conductive, non-magnetic refractory material such as molybdenum, or tungsten. The anode 36 may also be a horn of approximate curvature of the outer magnetic field lines of the plasma. A potential of about five hundred volts may be imposed between the anode 36 and the cathode 34 with an arc current of about ten amperes. Atomic ion production is not primarily dependent upon arc voltage but higher arc currents do produce higher atomic production.

Surrounding the ion source 10 are a number of solenoid magnets 28 and a monocusp magnet 30. The monocusp magnet 30 is positioned behind the reflector 32 and its purpose is to form the field cusp that performs as the electron filtering mechanism. The strength and position of the monocusp magnetic field prevents high energy electrons from passing to the aperture side 120 of the ion source 10. Although the monocusp magnetic field lines need not be normal to the axis 12, a major component of the monocusp magnetic field should be perpendicular to the axis 12 of the ion source 10. As described earlier, only the electrons having low energy are scattered from the cusp field and traverse to the aperture side 110 with the exception of axial electrons.

Although the ion source 10 shown in FIG. 1 illustrates a plurality of solenoid magnets 28, the ion source 10 actually requires at least one solenoid magnet 28 located between the monocusp magnet 30 and the cathode 34. The solenoid magnet 28 is configured so that a major component of the solenoidal magnetic field is parallel to the axis 12 of the ion source 10; moreover, the axial solenoidal magnetic field must intersect the cathode material 60 emission surface. Several solenoid magnets 28 may be implemented to create an even longer mean-free path for the electrons and these solenoid magnets 28 are located on both the cathode side 110 and the aperture side 120 of the monocusp magnet 30 and positioned accurately with respect to other solenoid magnets 28 and the monocusp magnet 30 so that roughly the axial magnetic field at half maximum coincides with the magnetic field at half maximum of the adjacent magnet, as shown in FIG. 2. In this fashion, the axial magnetic field strength is more or less constant as it extends on either side from the monocusp magnet 30. The solenoidal magnetic field strengths or the dimensions of the ion source, however, need not be equal or symmetric about the monocusp magnetic field, and may even vary in field strength on one or both sides of the monocusp magnet 30.

When the ion source 10 has a cylindrical geometry, the monocusp and the solenoid magnets, 30 and 28, are preferably rings formed by assembling a series of permanent bar magnets, with each magnet having the same pole arranged to face radially inward toward the axis 12 of the ion source 10 for the monocusp magnet 30 and for the solenoid magnets 28 the permanent bar magnets have their poles in the axial direction in alignment with the axial field generated by the monocusp magnet 30. The permanent bar magnets may be partially shunted or otherwise tuned, and even electromagnets may be used as solenoidal and monocusp magnets 28 and 30 to customize either or both the monocusp and the solenoidal magnetic fields for particular applications. The arrangement of the solenoid and monocusp rings 28 and 30 are used to form a unique field shown in FIG. 2, for confining the electrons and, therefore, for restricting the ions generated in the ion source 10 away from the side walls 24. The incorporation of the solenoidal magnets 28 allows the reduction of the diameter of cylinder or other cross-sectional dimension of other geometric configurations without raising the pressure within the vacuum envelope 100. The ion source 10 herein can operate with an axial magnetic field of approximately one thousand gauss away from the cusp which concentrates the plasma density near the axis 12; higher magnetic fields yield higher plasma density for a given arc current. The magnetic field at the face of the monocusp magnet 30 is approximately four kilogauss for a magnetic ring with an inside diameter of approximately two and one-half centimeters; this field strength is suitable for small single aperture sources.

Adjacent to the anode 36 and positioned between the anode 36 and the front plate 22 is a reflector plate 48 of molybdenum or other high melting point conductor. In the preferred cylindrical configuration, the reflector is a ring spaced from the inside diameter of the side wall 24 by feedthrough connectors 50. The reflector plate 48 normally floats at a potential of approximately halfway between anode and cathode potential or it may be set at a potential nearer to or at cathode potential which helps reflects electrons at the cusp field. The reflector 48 also helps prevents overheating of the side wall 24.

Spaced inwardly from the front plate 22, and preferably made of molybdenum, is aperture plate 42. The front plate 22 and the aperture plate 42 can be the same structure as shown in FIG. 1. The aperture plate 42 floats close to or may be set at anode potential. The structure and the features of the front plate 22 and the aperture plate 42 allow the implementation of a screen 44 to define the plasma boundary. A high voltage accelerator (not shown) extracts the ions from the plasma boundary near the aperture 40 in the aperture plate 42. The polarity of the electric field outside the source 10 is such that electrons trying to exit the ion source 10 are reflected back into the source and positively charged ions are extracted from the source to form an ion beam. This invention may also incorporate an electron beam catcher 54 in FIGS. 1 and 3 behind the cathode to absorb the high energy electrons from the accelerator region because the configuration of the cathode herein is hollow. The shape and dimensions of the aperture 40 or a focus electrode could be incorporated into the aperture plate 42 or the front plate 22 to help focus the ion beam at the aperture 40. The use of the solenoidal magnet 28 closest to the aperture 40 can be specifically tuned or set at a distance from the aperture 40 to accommodate beam optics.

Figure 5:
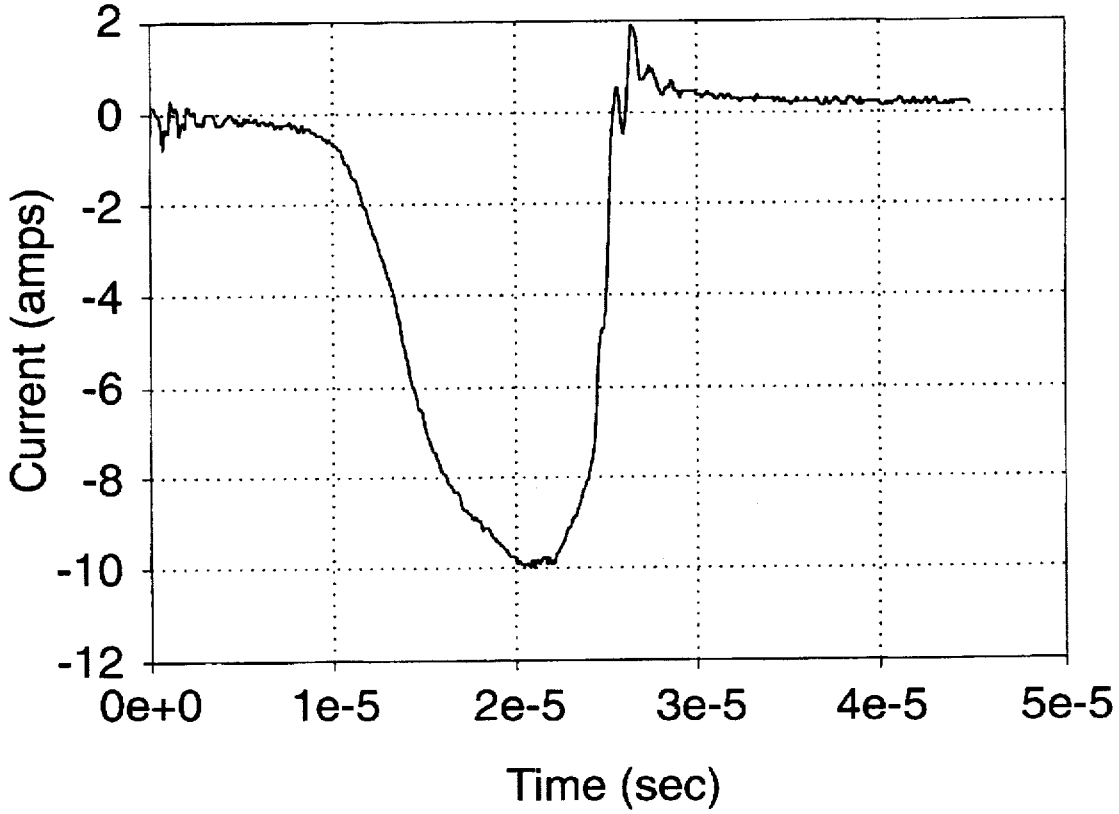
FIG. 5 is a plot of the deuterium current as a function of time for the ion source shown in FIG. 4.

When the cathode 34 is continuously heated, the ion source 10 stabilizes quickly for pulsed operation. The ion source 10 could also be operated in a dc mode provided sufficient cooling is used; pulsed operation, however, is preferred. The deuterium ion current as a function of time during a pulse is shown in FIG. 5. The peak ion current was approximately one hundred fifty milliamperes for an extraction field of one kilovolt per millimeter electric field at twelve amperes of arc current. The pulse width can be adjusted from ten microseconds wide to continuous operation and at pulse repetition rates greater than thirty pulses per second. Approximately five hundred milliamperes of deuterium ions from a six millimeter diameter hole have been measured at the extraction field above. Higher extraction fields reduce space charge effects and increase ion beam current. The ion source has been operated at pressures between three to five millitorr. These pressures are an order of magnitude lower than the existing Zetatron neutron tube. These lower pressures allow higher ion currents and less secondary electron back streaming from the accelerator region.

Figure 6:
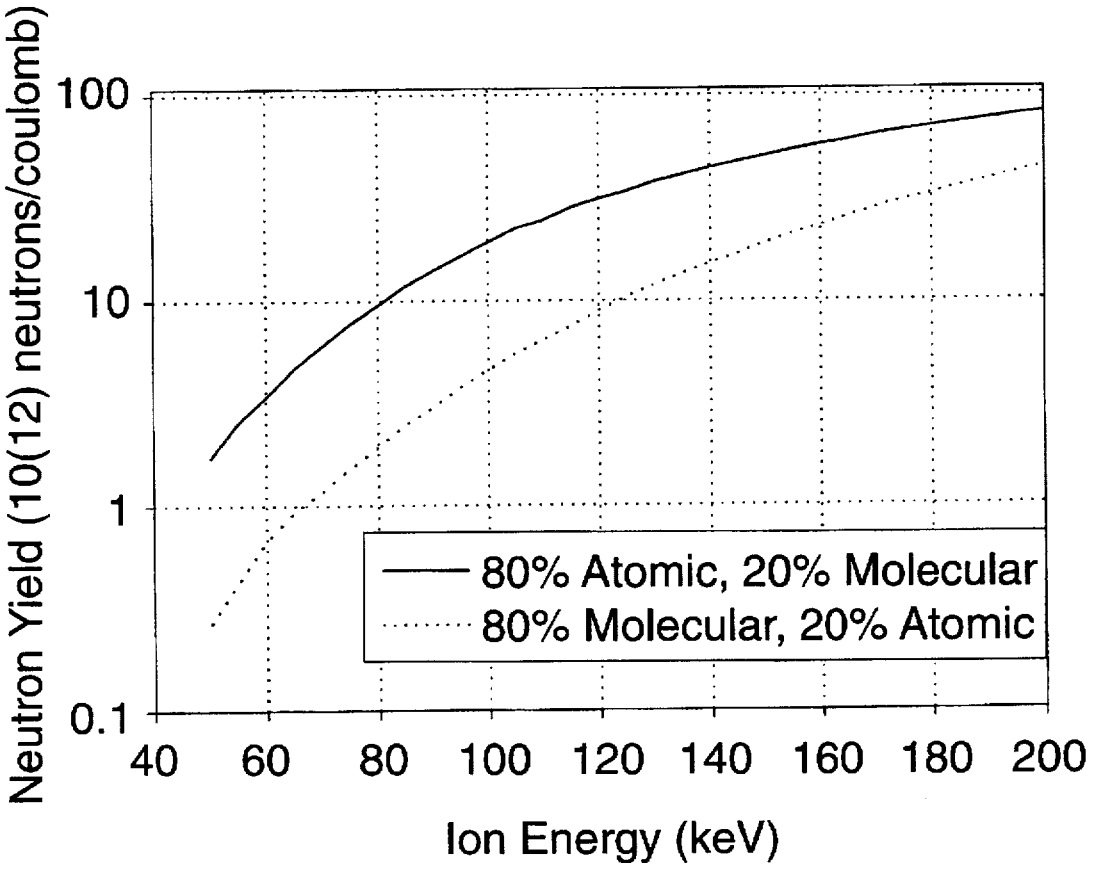
FIG. 6 is a graphical comparison of the neutron yield in terms of neutron/microcoloumb as a function of ion beam energy at the target for the ion source of the invention and an existing Penning discharge.

A calculated comparison of the yield in neutrons/microcoloumb as a function of ion beam energy for the ion source 10, the top curve, and an existing Penning discharge ion source, the bottom curve, with a fifty percent deuterium and fifty percent tritium gas mixture is shown in FIG. 6. This particular deuterium/tritium gas mixture is often used in neutron tubes. The ion source 10 described herein produced eighty percent atomic ions ($D^+$, $T^+$) and twenty percent molecular ions at three millitorr whereas the Penning ion source produced approximately eighty percent diatomic ($D_2^+$, $T_2^+$) ions, fifteen percent triatomic ($D_3^+$, $T_3^+$) ions, and only five percent atomic ions at thirty millitorr. As seen from FIG. 6, the neutron yield for the ion source 10 is a factor of four greater than the existing Penning discharge at one hundred kilovolts. Relative to the Penning ion source used in existing neutron generators, the atomic ion species is a factor of eighteen greater and the pressure is a factor of eight lower. For the same tube current the ion source 10 described herein can produce up to ten times the neutron output of the Penning tube because sixty percent of the Penning tube current are secondary electrons generated from its high pressure operation which, of course, do not produce neutrons. Because of the low operating pressure of the ion source, higher voltages can be achieved and less secondary electrons will be produced in the accelerating region.

The combination of higher atomic species, higher operating voltages, and less electron current gives over an order of magnitude increase in neutron rate at the same accelerator current. Within a neutron generator the ion source enables the generator to generate up to an order of magnitude higher neutron rate than existing neutron generators of comparable size and power. This rate will allow greater sensitivity for the detection of hazardous materials by neutron activation analysis.

Accordingly, it is not intended that the scope of the claims appended hereto be limited to the description set forth therein, but rather that the claims be construed as encompassing all the features of patentable novelty that reside in the present invention, including all features that would be treated as equivalents thereof by those skilled in the art to which this invention pertains.

What is claimed is:

1. An atomic-hydrogen ion source comprising:

(a) a nonmagnetic housing enclosing a vacuum envelope between a rear wall and a front wall, said front wall having an aperture for passage of ions and an ion beam from said housing;

(b) a cathode positioned within said housing near but electrically insulated from said rear wall;

(c) an anode supported between said cathode and said aperture within said housing, said anode for energizing electrons emitted from said cathode when a voltage is applied between said anode and said cathode, said anode being electrically insulated from said cathode and said housing;

(d) a reflector within said housing located between said anode and said aperture, said reflector being electrically insulated from said cathode, said anode and said housing;

(e) a monocusp magnet positioned on the exterior of said nonmagnetic housing behind and adjacent to said reflector, said monocusp magnet for forming a monocusp magnetic field on said reflector;

(d) at least two permanent solenoid magnets, each set positioned along the exterior of said nonmagnetic housing on each side of said monocusp magnet, one set towards said cathode and the other set towards said aperture, said at least two permanent solenoid magnets for forming an axial solenoidal magnetic field to extend the path length of electrons, the relative strengths and positions of the solenoid magnets with respect to the cusp magnet generates a unique magnetic field configuration inside the small volume ion source for generating atomic, not molecular, hydrogen ions;

(g) a gas source to fill said vacuum envelope with a gas which is ionized by electrons to form a plasma;

whereby electrons emitted from said cathode are accelerated toward said anode along lines of said axial solenoidal magnetic field and are reflected at said monocusp magnetic field at said reflector wherein said electrons travel between said cathode and said reflector along said line of said solenoidal and monocusp magnetic fields; said electrons ionizes said gas within said vacuum envelope into molecular ions and said molecular ions pass through said monocusp magnetic field toward said aperture and dissociate into atomic ions by low energy electrons that have been scattered towards said aperture.

2. The ion source of claim 1 whereby said anode grazes an outer boundary of said plasma.

3. The ion source of claim 2 whereby said anode has a curvature following the outer curvature of the said magnetic fields at an outer boundary of said plasma.

4. The ion source of claim 1 wherein said reflector is at a floating potential.

5. The ion source of claim 1 wherein said monocusp magnet is a permanent bar magnet.

6. The ion source of claim 5 wherein said permanent bar magnet is partially shunted.

7. The ion source of claim 1 wherein said monocusp magnet is a ring.

8. The ion source of claim 1 further comprising more than one solenoid magnet.

9. The ion source of claim 8 wherein at least one of said solenoid magnets is on a side of said monocusp magnet toward said aperture.

10. The ion source of claim 9 wherein the solenoidal field strength on said aperture side of said monocusp magnet is different that the solenoidal field strength on said cathode side of said monocusp magnet.

11. The ion source of claim 1 wherein said solenoid magnet is a permanent bar magnet.

12. The ion source of claim 11 wherein said solenoid magnet is partially shunted.

13. The ion source of claim 11 wherein said solenoid magnet is a ring.

14. The ion source of claim 1 wherein the magnetic field strength at half maximum on said axis coincides with the magnetic field strength at half maximum of an adjacent magna.

15. The ion source of claim 9 wherein the distance between aperture and said solenoid magnet closest to said aperture is varied so that said ion beam exiting said aperture can match beam optics exterior to said housing.

16. The ion source of claim 1 wherein said aperture is at floating potential.

17. The ion source of claim 1 wherein said aperture is set at or near anode potential.

18. The ion source of claim 1 wherein a screen at said aperture defines a boundary of said plasma.

19. The ion source of claim 1 wherein the shape and dimensions of said aperture focuses said ion beam.

20. The ion source of claim 1 further comprising a focus electrode external to said vacuum envelope near said aperture to focus said ion beam.

21. The ion source of claim 1 further comprising a electron beam catcher located axially behind said cathode to absorb high energy electrons.

22. A method for generating hydrogen ions with high atomic purity, said method comprising:

(a) configuring a long electron path between a cathode and a magnetic cusp field using a permanent solenoidal magnetic field created by a plurality of permanent solenoidal magnets disposed along a nonmagnetic housing which covers a vacuum envelope containing said cathode, the positions and strengths of the permanent magnets with respect to the cusp magnet are absolutely essential for generating the correct magnetic field configuration for generating atomic hydrogen ions;

(b) pressurizing a source of molecular gas;

(c) energizing said cathode and an anode; and (d) heating said cathode until electrons are emitted, creating an arc between said cathode and said anode; and (e) reflecting said emitted electrons from said cathode between said magnetic cusp field and said cathode along said solenoidal magnetic field, and wherein said emitted electrons ionize said molecular gas into molecular ions forming a plasma within said vacuum envelope, and where said molecular ions pass through said magnetic cusp field toward an aperture and dissociate into atomic ions by low energy electrons that have been scattered towards said aperture, another set of solenoidal magnets transport low energy electrons between the cusp field and the aperture.

23. A method of claim 22, wherein said step of energizing are pulsed.

24. The method of claim 23 wherein said molecular gas is molecular hydrogen.

25. An ion source comprising:

(a) a coaxial cylindrical nonmagnetic housing enclosing a vacuum envelope between a rear wall and a front wall, said front wall having an aperture for passage of ions from said housing;

(b) a gas source to fill said vacuum envelope with a gas which ionizes to form a plasma;

(c) a hollow truncated cone cathode having lanthanum hexaboride as an electron emitting material, said cathode positioned coaxially within said housing near but electrically insulated from said rear wall;

(d) a coaxial anode ring supported between said cathode and said aperture within said housing so that said anode ring grazes an outer boundary of said plasma, said anode ring for energizing electrons emitted from said cathode when a voltage is applied between said anode ring and said cathode, said anode ring being electrically insulated from said cathode and said housing;

(e) a reflector ring within said housing located axially between said anode ring and said aperture, said reflector ring being at a potential between said cathode and said anode ring and electrically insulated from said cathode, said anode ring, and said housing;

(f) a permanent bar monocusp magnetic ring, positioned exterior to said vacuum envelope behind and adjacent to said reflector, said monocusp magnetic ring for forming a monocusp magnetic field on said reflector ring having a major monocusp magnetic field component axially perpendicular;

(g) at least one coaxial solenoid magnetic ring positioned exterior to said vacuum envelope on a side of said monocusp magnet towards said cathode, said solenoid magnet for forming an solenoidal magnetic field to extend the path length of electrons with said solenoidal magnetic field having a major component coaxially parallel and intersecting a surface of said cathode material;

whereby electrons emitted from said cathode and accelerated toward said anode ring along said solenoidal magnetic field lines and are reflected at said monocusp magnetic field at said reflector ring and travel between said cathode and said reflector ring along said solenoidal and monocusp magnetic field lines, which electrons ionize said gas within said vacuum envelope into molecular ions and said molecular ions pass through said monocusp magnetic field toward said aperture and dissociate into atomic ions by low energy electrons that have been scattered towards said aperture.

* * * * *